United States Patent [19]

Chiu

[11] 4,307,303

[45] Dec. 22, 1981

[54] CYCLIC ELECTRIC TIME SWITCH MEANS

[76] Inventor: Ching H. Chiu, Flat 419, Block 10 (Upper) Wong Tai Sin, Kowloon, Hong Kong

[21] Appl. No.: 92,057

[22] Filed: Nov. 6, 1979

[51] Int. Cl.[3] ..... H01H 43/00

[52] U.S. Cl. ..... 307/141; 200/27 B; 200/38 BA; 200/38 D; 200/38 F

[58] Field of Search ..... 200/27 B, 38 B, 38 BA, 200/38 D, 38 DA, 38 R, 38 F; 307/141, 141.4, 141.8

[56] References Cited

U.S. PATENT DOCUMENTS 3,867,642 2/1975 Ajrlahi ..... 200/38 D X

*Primary Examiner*—George H. Miller, Jr.
*Assistant Examiner*—James L. Dwyer
*Attorney, Agent, or Firm*—Maky, Renner, Otto & Boisselle

[57] ABSTRACT

Cyclic electric time switch means has a housing with an electrical clock therein and trip contact means comprising a toothed gear wheel coupled to a drive gear of the clock and mounting gear wheel. The disc mounts an electrical switch having contact terminals slidingly engaged with conductive tracks of a further settable disc and connection means are provided to connect a device to be supplied with power under the control of the time switch means. A trip arm is provided on the gear wheel to operate the electrical switch in one position of rotation of the gear wheel according to the setting effected by a manually settable control knob. A delay circuit provides, at the end of a delay period following operation of the electrical switch, restoration of the electrical switch via electromagnetic means for repetition of the operation by the trip arm when the gear wheel again reaches said one position of rotation.

4 Claims, 5 Drawing Figures

CYCLIC ELECTRIC TIME SWITCH MEANS

The invention relates to cyclic electric time switch means.

It is among the objects of the invention to provide cyclic electric time switch means which at times set thereon can cause operation of an electrical switch to cause power to flow to apparatus reliably to effect a desired operation, such operation being repeated at daily or twice daily intervals if required.

The invention provides cyclic electric time switch means comprising in combination a housing, an electrical clock in said housing, said electrical clock having a toothed drive gear, and trip contact means, said trip contact means comprising a toothed gear wheel coupled to said toothed drive gear of said electrical clock to be rotated thereby, a disc mounted coaxial with said toothed gear wheel, angularly adjustable with respect to said toothed gear wheel and mounting an electrical switch, a further settable disc, said electrical switch having contact terminals slidingly engaged with conductive tracks of said further settable disc, connection means whereby a device to be supplied with electrical power under the control of said electric time switch means can be connected to said further settable disc, a trip arm on said toothed gear wheel effective, in one position of rotation of said toothed gear wheel determined by the angular setting of said electrical switch, to operate said electrical switch, a manually settable control knob, said settable disc being rotatable with respect to said toothed gear wheel, for setting the desired instant of trip or operation of said electrical switch by said trip arm, by said manually settable control knob, a delay circuit and electromagnetic means energised through said delay circuit, following operation of the electrical switch, and effective, at the end of a delay period set by said delay circuit, to restore said electrical switch for repetition of said operation by said trip arm when said toothed gear wheel again attains said one position of rotation.

The delay circuit may comprise a heating coil and a heat sensitive switch located adjacent the heating coil.

Alternatively, for short cycle times, the delay circuit may comprise a capacitor-resistor network cooperating with at least one transistor.

Advantageously a plurality of said trip contact means are provided in series and said electromagnet means are only energised through said delay circuit when all of said plurality of trip contact means have operated.

Such cyclic time control means, which can energise and de-energise other devices at pre-set times, have wide and varied applications, for example control of a cooker to cook food, feeding of pet animals while the owner is away, control of irrigation of agricultural crops or, with short cycle times, control of traffic lights or advertising display lights.

Therefore each switch can thus control supply of electrical power to a socket or respective socket(s) to which a device to be time controlled can be connected to be powered thereby selectively under the control of the cyclic electric time switch means.

The invention is diagrammatically illustrated by way of example in the accompanying drawings, in which.

Figure 1:
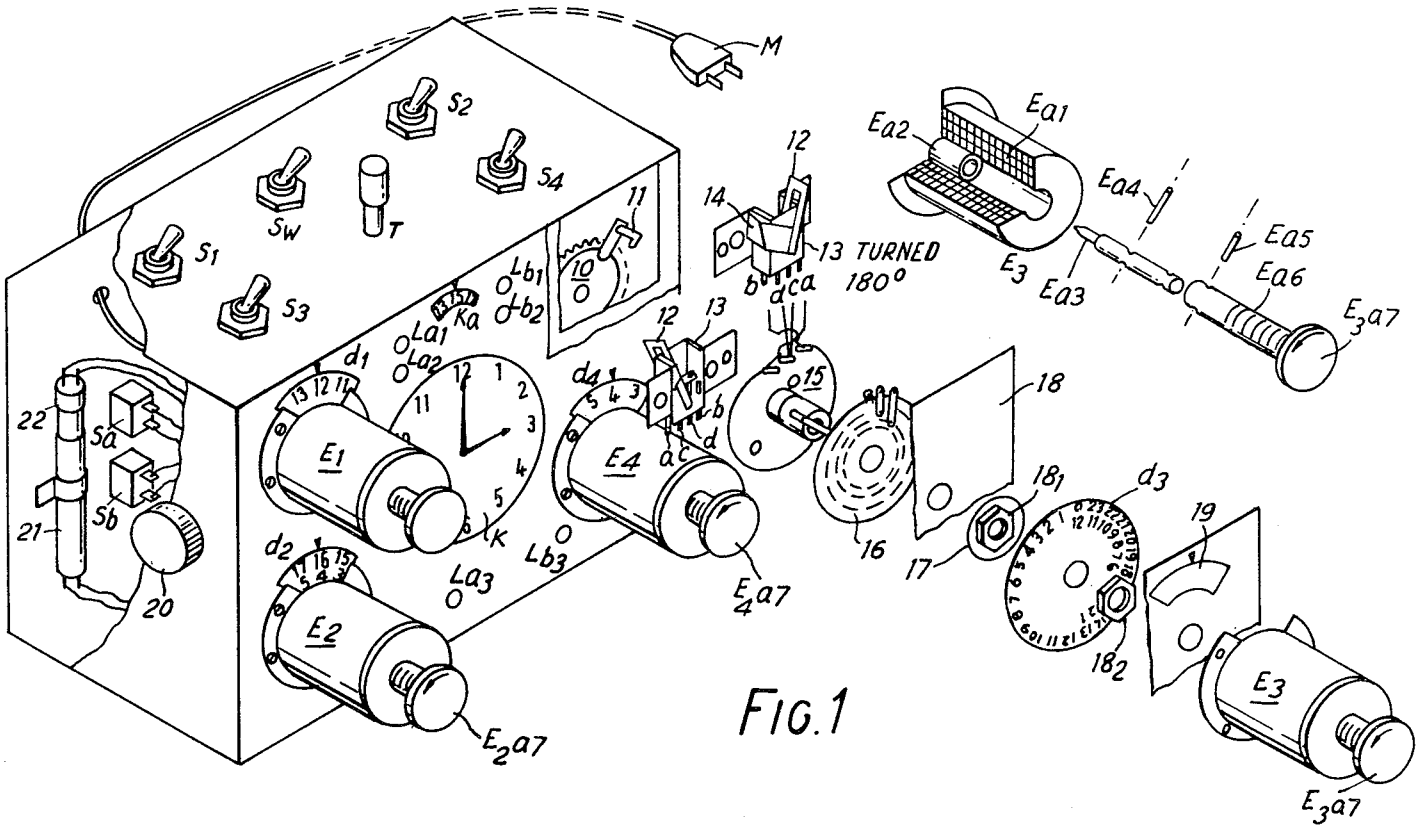
FIG. 1 is a partially exploded perspective view of cyclic electric time switch means according to the invention.

Referring to the drawings, cyclic electric time switch means comprises a housing mounting an electric clock K which can be powered from a mains electrical connection M. In the embodiment shown four trip contact means E1, E2, E3 and E4 are provided, the trip contact means E3 being shown exploded in FIG. 1. Each trip contact means has a gear wheel 10 which is rotated by a drive gear of the clock K in synchronism therewith and each gear wheel 10 has a trip arm 11 mounted thereon. Each trip arm 11 cooperates with the arm 12 of a respective two-way throw switch 13 to move the arm 12 when the time on the clock K corresponds to the time set on a dial d3 of the respective trip contact means E1 to E4 as explained hereinafter. The switch 13 is illustrated twice in FIG. 1, the lower left illustration showing it in its orientation in use and the upper right illustration showing it turned through 180° to illustrate a plate spring part 14 of the arm 12 which can be engaged by a trip pin Ea3 to throw the arm 12 to the left as viewed in FIG. 1 to open the circuit i.e. to move the switch 13 to a condition which it was in before the arm 12 was moved by the trip arm 11.

The cyclic electric time switch means includes five manually operable switches S1, S2, S3, S4 and Sw and a knob T for adjusting the time clock K. It also includes two power sockets Sa and Sb into which devices to be controlled by the cyclic electric time switch means can be plugged, thereby to be energised and de-energised under the control of the cyclic electric time switch means. Indicating lights La1, Lb1, La2 and Lb2 are provided for the switches S1 to S4 respectively and indicating lights La3 and La4 are provided to indicate whether or not the sockets Sa and Sb respectively are energised. The switch Sw is a master control switch for restricting operation to a single cycle as will be described hereinafter.

Figure 2A:
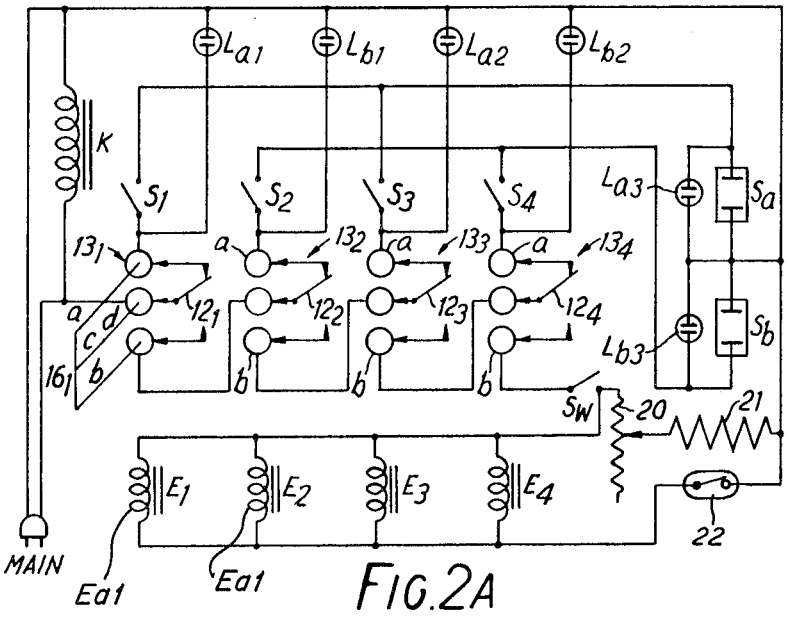
FIG. 2A is a circuit diagram of the cyclic electric time switch means of FIG. 1.

Referring to FIG. 2A, each switch 13 with its movable arm 12 has four terminals a, b, c, and d; terminals c and d being common and connected to the contact of the movable arm 12 and the terminal a being connected to the respective switches S1 to S4. The terminal b of the switch $13_1$ is connected to the movable contact of the switch $13_2$, the terminal b of the switch $13_2$ is connected to the movable contact of the switch $13_3$, the terminal b of the switch $13_3$ is connected to the movable contact of the switch $13_4$ and the terminal b of the switch $13_4$ is connected to one terminal of the master switch Sw which is connected to time delay means. The time delay means comprises a variable resistance 20, a heating coil 21 and a heat sensitive switch 22 adjacent the heating coil to control energisation of coils Ea1 (several of which are labeled in FIG. 2A) of solenoids of the respective time setting means in respective trip contact means E1, E2, E3, and E4.

Each switch 13 is mounted on a rotatable disc 15 and the four terminals 13*a*, 13*b*, 13*c* and 13*d* of the switch 13 are connected to the disc 15 which is rotatable by a setting knob such as E3a7, the disc 15 having three contacts, the middle one of which connects the terminals 13*c* and 13*d* together. A stationary disc 16 has in the face thereof three conductive tracks which make connections respectively with the three contacts of the disc 15 whatever the angle to which the disc 15 is turned. The dial is a further disc having time markings, in the embodiment shown twenty four divisions representing a twenty four hour period. The disc d3 is fixed on the same shaft as the disc 15 by a spring ring 17 and two threaded nuts $18_1$ and $18_2$ located between an inside wall 18 of the housing of the cyclic electric time switch means and an outside wall having a window 19 through which the time set on the disc d3 can be read.

The solenoid in trip contact means E3 comprises a cylinder with a magnetic coil Ea1 therein and a core tube Ea2 which, when the coil Ea1 is energised attracts the trip pin Ea3 thereinto by magnetic force. Ea4 and Ea5 are transverse pins, Ea4 tightly holding the trip pin Ea3 and the disc 15 together, and Ea5 holding the trip pin Ea3 and the disc d3 together so that the disc 15 and the disc d3 can be rotated by the setting knob E3a7. Ea6 is a spring to bias the trip pin Ea3 to withdraw from the core tube Ea2 when the coil Ea1 is de-energised and its magnetic field collapses. The manual setting knob E3a7 for the disc d3 allows the required time to be set on the dial d3.

The setting is made when the knobs Ea7 and hence the trip pins Ea3 are pushed in to engage the plate springs 14 and force the switch arms 12 to the left as viewed in FIG. 1. At the respective set times, each trip arm 11 moves the associated switch arm 12 to the right in describing an arc taking about ten minutes before the hooked trip arm 11 dis-engages from the switch arm 12. During this time the flow of current through coils E1 to E4 is delayed by passing the current through the variable resistance 20 and the heating coil 21 which, when heated to a sufficient degree, closes the heat sensitive switch 22 thereby to cause all the four trip pins Ea3 of the solenoids in trip contact means E1, E2, E3 and E4 to be drawn into the respective tubes Ea2 thereof to engage the plate springs 14 and hence the switch arms 12 to change-over the switch arms 12 to the starting position for another round of operation.

The switches S1 and S3 control the socket Sa and the switches S2 and S4 the socket Sb. The master switch Sw permits cyclic operation when it is closed, if cyclic operation is not required, that is to say repetitive operation is not required, then the switch Sw is left open and there is therefore no re-setting after one operation.

Thus the magnetic coil Ea1 is energised only when all the arms 12, i.e. including the last arm $12_4$, are in the down position as viewed in FIG. 2A before the trip pin Ea3, also Ea1, Ea2 and Ea4 are drawn-in to trip the trip plates $14_1$ to $14_4$ and move the arms $12_1$ to $12_4$ to the left to cut-off the circuits of coils Ea1 to Ea4 to start another trip cycle following the delay set by the current passing through the heat sensitive elements. The setting times are sequential having regard to the clock K, i.e. they follow one after another until the sequence is complete.

Figure 2B:
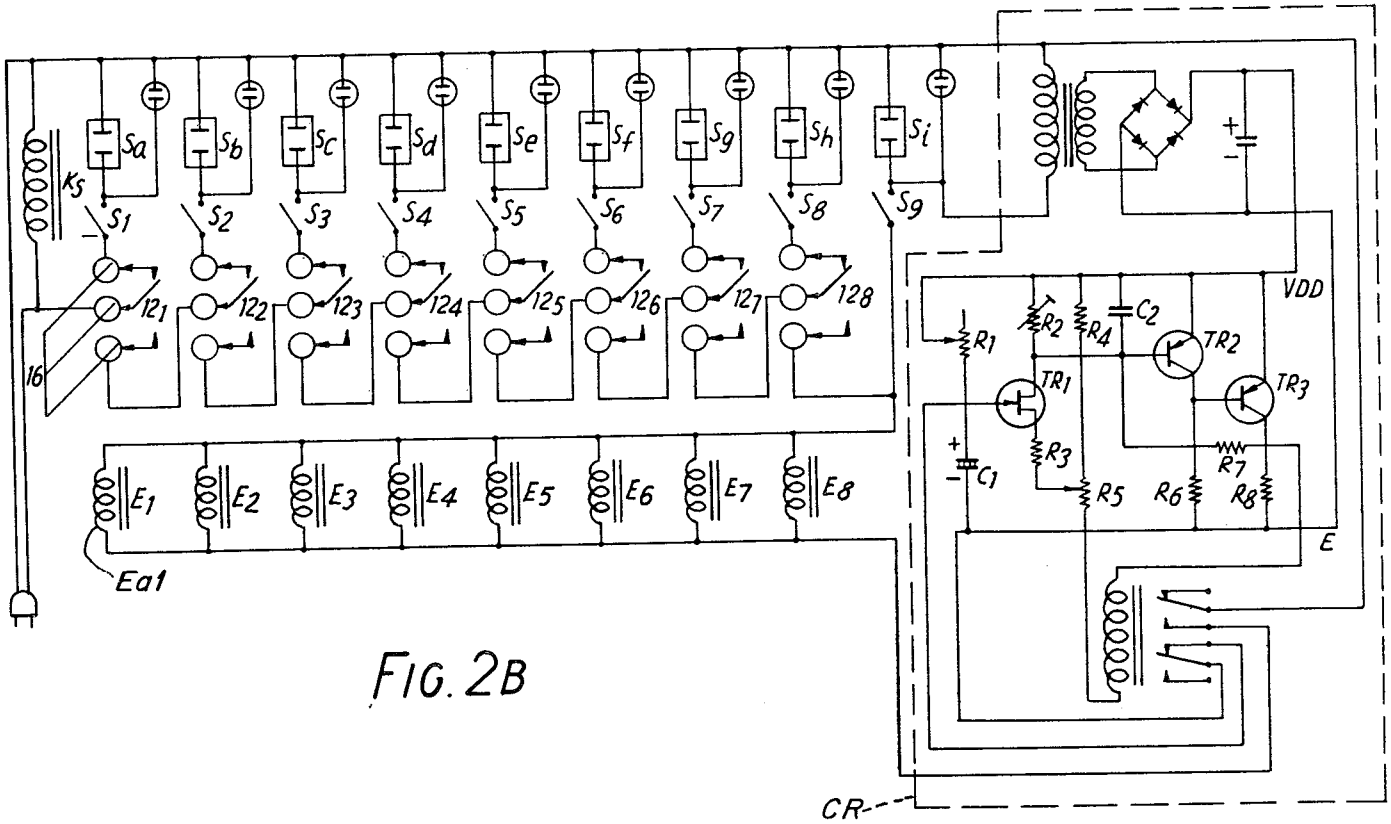
FIG. 2B is a circuit diagram of a modified cyclic electric time switch means for short cycle times.

Referring to FIG. 2B, this shows two circuits of the kind shown in FIG. 2A connected in series but omitting the delay elements 20, 21 and 22, which for example can give a delay of 10 to 15 minutes, and replacing them by an electronic CR control circuit enclosed in a dotted line box.

TR1 is a field effect transistor with, on its control base, capacitor-resistor time controlling elements C1R1. Transistor TR2 and TR3 cooperate to give an amplifying effect and to make and break the relay circuit. Variable resistors R2 and R5 give adjustment of the working point and the variable resistor R1 and capacitor C1 allow adjustment of the time control interval, for example between half a second and one second or longer if required.

EXAMPLES OF OPERATION

Cyclic

Figure 3:
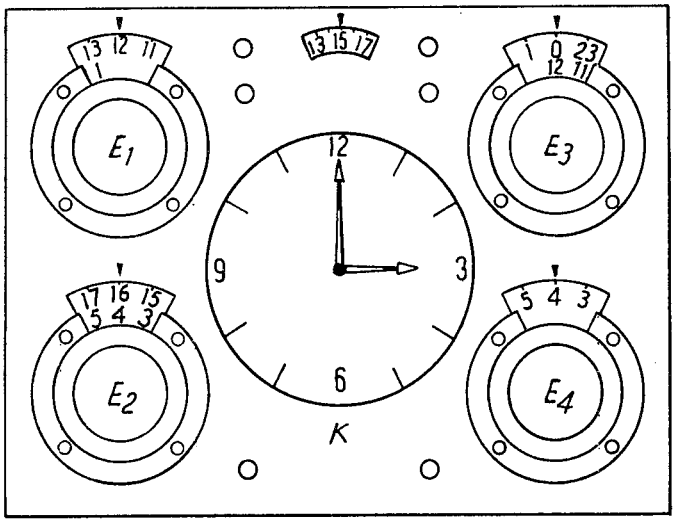
FIG. 3 is an elevation of the cyclic electric time switch means of FIG. 1 showing a particular setting of the time control means.

1. Spraying of lawn or vegetation field:
   Requirement:
   Twice daily in a 24 hours cycle:
   a. at 7 to 7.30 hours
   b. at 17 to 17.30 hours
   Setting with reference to FIGS. 1, 2 and 3:
   a. with socket Sa plugged to spraying mechanism
   b. close switches S1, S2, S3, S4 and Sw
   c. before anytime, set d4 at, i.e. time dial disc "d" in trip contact means E4, 6.45 hours to let the heat sensitive switch 22 warm up
   d. then d4 at 7 hours starts the spraying
   e. set d1 at 7.30 hours to stop spraying
   f. set d2 at 17 hours to start spraying
   g. set d3 at 17.30 hours to stop spraying
   Next day the same operation repeats itself.
2. Feeding household pets:
   Requirement:
   Twice daily in a 24 hour cycle:
   a. at 7.50 to 8.00 hours a bell rings
   b. at 8.00 to 8.30 hours food is provided
   c. at 17.50 to 18.00 hours a bell rings
   d. at 18.00 to 18.30 hours food is again provided
   Setting with reference to FIG. 4:
   a. plug sockets Sa and Sd to bell; plug Sb and Se to food supplying mechanism; leaving Sc and Sf and the rest open
   b. close all the switches S1 to S4 and Sw
   c. before anytime, set d6 at 7.35 hours to allow 15 minutes for heat switch to warm up
   d. set d7, d8 at 7.35 hours as above; then at 7.50 hours the bell starts to ring
   e. set d1 at 8.00 hours food is provided
   f. set d2 at 8.30 hours food is no longer provided
   g. set d3 at 17.50 hours at start bell ringing
   h. set d4 at 18.00 hours to start feeding
   i. set d5 at 18.30 hours to stop feeding Next day the same operation repeats.

At any time either socket Sa or socket Sb can be energised but they can not be energised together. However using the circuit of FIG. 4 a plurality of circuits can be energised together or more than two panels of FIG. 2 can be used in series, the setting control E4 of the last panel controlling the cyclic operation.

Figure 4:
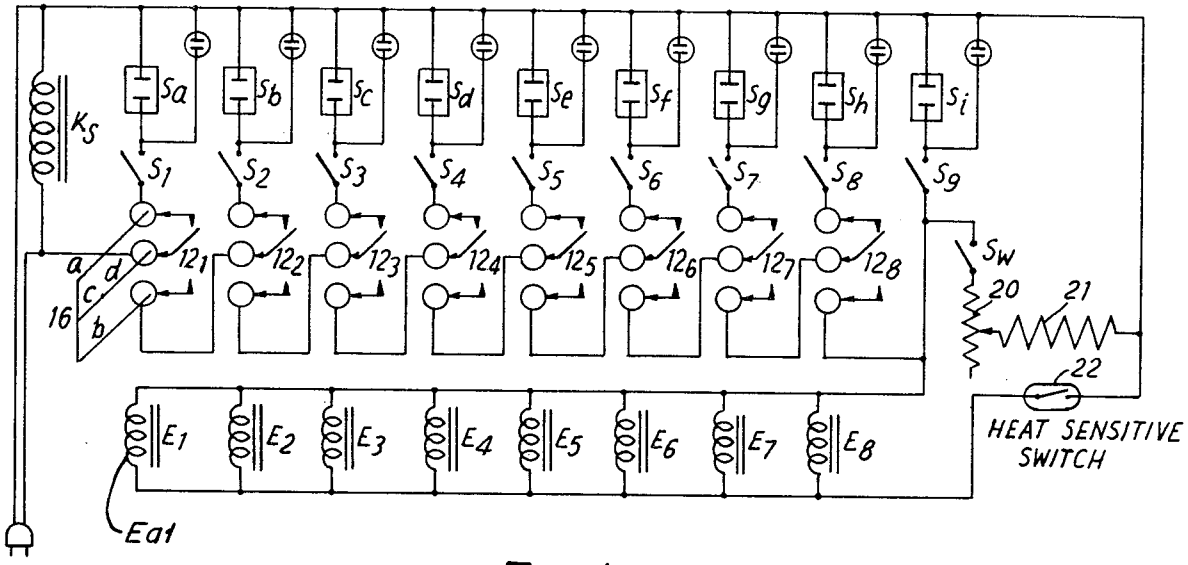
FIG. 4 shows an extended version of the circuit of FIG. 2A.

For multiple movements in machinery operation the circuit of FIG. 4 can be arranged so that each switch S controls a respective socket i.e. switch S1 controls socket Sa, switch S2 controls socket sb etc., for special movement particularly where energisation of a socket for only a few seconds is required. The cyclic time is therefore in minutes rather than in 24 hours and a suitable clock KS is employed.

What is claimed is:

1. Cyclic electric time switch means comprising in combination a housing, an electrical clock in said housing, said electrical clock having a toothed drive gear, and trip contact means, said trip contact means comprising a toothed gear wheel coupled to said toothed drive gear of said electrical clock to be rotated thereby, a disc mounted coaxial with said toothed gear wheel, angularly adjustable with respect to said toothed gear wheel and mounting an electrical switch, a further settable disc, said electrical switch having contact terminals slidingly engaged with conductive tracks of said further settable disc, connection means whereby a device to be supplied with electrical power under the control of said electric time switch means can be connected to said further settable disc, a trip arm on said toothed gear wheel effective, in one position of rotation of said toothed gear wheel determined by the angular setting of said electrical switch, to operate said electrical switch, a manually settable control knob, said settable disc being rotatable with respect to said toothed gear wheel, for setting the desired instant of trip, by said manually settable control knob, a delay circuit and electromagnetic means energised through said delay circuit, following operation of the electrical switch, and effective, at the end of a delay period set by said delay circuit, to restore said electrical switch for repetition of said operation by said trip arm when said toothed gear wheel again attains said one position of rotation.

2. Cyclic electric time switch means as claimed in claim 1, wherein said delay circuit comprises a heating coil and a heat sensitive switch located adjacent said heating coil.

3. Cyclic electric time switch means as claimed in claim 1, wherein said delay circuit comprises a capacitor-resistor network cooperating with at least one transistor.

4. Cyclic electric time switch means as claimed in claim 1, wherein a plurality of said trip contact means are provided in series and said electromagnetic means are only energised through said delay circuit when all of said plurality of trip contact means have operated.

* * * * *